United States Patent [19]

Taeckens

[11] Patent Number: 4,954,190

[45] Date of Patent: Sep. 4, 1990

[54] METHOD AND MEANS FOR SUPPLYING AND USING ARTIFICIAL FINGERNAIL MATERIAL

[76] Inventor: Sandra D. Taeckens, 77811 Calle Sinaloa, La Quinta, Calif. 92253

[21] Appl. No.: 353,867

[22] Filed: May 18, 1989

[51] Int. Cl.[5] ..... B32B 31/12; A45D 31/00

[52] U.S. Cl. ..... 156/61; 132/73; 156/248; 156/249; 156/257; 428/15

[58] Field of Search ..... 132/73; 156/61, 257, 156/248, 249; 428/15

[56] References Cited

U.S. PATENT DOCUMENTS 2,633,139 3/1953 Pettey ..... 132/73

4,627,453 12/1986 Isler ..... 132/73

*Primary Examiner*—Robert A. Dawson

*Attorney, Agent, or Firm*—Herbert C. Schulze

[57] ABSTRACT

A method and apparatus for supply and using artificial fingernail material wherein the material comprises porous fabric-like material supplied in sheets which are die cut in advance to the appropriate size for a person's fingernails and are supplied on a backing board upon which they are die cut and within a plastic wrap package appropriately scored so that strips of the plastic may be removed and utilized in pressing the individual fabric fingernail coverings over the nail, which will first be supplied with an artifical tip, and which, with the tip, already has a special adhesive polish material applied, in such manner that the adhesive polish material is forced upwardly through the fabric, after which a finish coating of polish is applied and the fabric nail is trimmed and polished to the appropriate final desired shape.

3 Claims, 3 Drawing Sheets

METHOD AND MEANS FOR SUPPLYING AND USING ARTIFICIAL FINGERNAIL MATERIAL

CROSS REFERENCE TO RELATED PATENT APPLICATIONS

There are no patent applications filed by me related to the within application.

BACKGROUND OF THE INVENTION

I. Field of the Invention

This invention is in the general field of artificial fingernails; the invention is more particularly directed to a method and apparatus for the supply of fabric material which can be formed into adhering artificial nails when used in conjunction with a natural fingernail and an artificial tip, with appropriate adhesive polish; the invention is even more particularly directed to a method and apparatus for supplying pre-shaped fabric elements to be used as set forth.

II. Description of the Prior Art

It is known to utilize certain types of fabric, most commonly linen, fiberglass or other materials for forming a fingernail upon an artificial nail. It is common to take a piece of such fabric and attempt to shape it to an individual fingernail and to attempt to cause it to adhere by the use of adhesives and to color the entire nail so formed with a desired nail polish color.

My invention includes the method and apparatus for supplying properly pre-cut sheets of fabric mounted appropriately upon a base cutting board and within a plastic container having pre-marked strips which can be removed to be used for forcing adhesive through the pre-cut fabric nail coverings. Prior to my invention I know of no pre-existing method or apparatus for supplying pre-cut fingernail fabric material as briefly stated herein and as stated in more detail in the following specifications, together with the use of an artificial tip adhered to the natural nail.

SUMMARY OF THE INVENTION

The use of artificial fingernails of various types has become very wide spread and there are numerous ways in which artificial fingernails are created and used. Some examples of artificial fingernails are pre-shaped acrylic or other firm material which will be adhered to the natural fingernail by some type of adhesive, the use of various built up layers of material, and the use of fabrics such as linen in conjunction with resin materials or the like to create a hard fingernail like material on top of the natural fingernail.

There are certain disadvantages to the use of pre-shaped fingernails made of rigid material such as acrylic or the like and likewise there are disadvantages to certain methods of building up nails which are involved with time consumed and cost thereof.

A widely accepted method for creating artificial fingernails is with the use of a fabric material such as linen, fiberglass, and the like, which is porous and may be impregnated with a resin or other suitable material which hardens when dry so as to create an artificial fingernail on top of a natural fingernail and which has characteristics when so formed very much like the natural nail.

A major problem for individuals and professionals using the fabric fingernails is time and difficulty of appropriately cutting the fabric materials which are customarily difficult to cut cleanly. In order to create a fairly satisfactory artificial fingernail in this manner it is necessary to spend a great deal of time and to waste a great deal of material in achieving a proper shape and overall characteristics. Additionally it is difficult to create a proper extending tip of this material.

I have studied this problem at length and have made a long and detailed survey of fingernail sizes and shapes. I have found that five basic shapes will provide suitable and attractive shapes for the vast majority of all persons using artificial fingernails.

I have further found that by mounting a sheet of appropriate fabric material upon a backing board that I can then die-cut through the fabric material in such manner that the fabric material so die-cut remains lightly attached to the sheet of fabric material, but is sufficiently cut so as to be easily removed by the person using the individual pieces of fabric material. Thus, it is possible for anyone to have perfectly shaped fabric segments to be used for the creation of the fabric artificial fingernails.

I have further found that I can package this material in suitable plastic envelopes which have been pre-marked and scored so as to allow the separation of suitable plastic strips for use in applying the fabric onto an adhesive polish upon the natural nail, together with an artificial tip extending outwardly from, and attached to, the natural nail. After the material adheres properly and the adhesive polish material has set within the fabric so as to create a firm artificial fingernail, trimming and final finish may be accomplished by cutting, sanding, and buffing materials such as would be commonly used with the shaping and final polishing of natural fingernails.

It is an object of this invention to provide pre-shaped fabric material for use in creating artificial fingernails;

It is a further object of this invention to supply such pre-shaped fabric segments in suitable sizes to accommodate the desired sizes and shapes of the fingernails of the majority of the population using artificial fingernails;

It is another object of this invention to provide such pre-cut material in such condition that it is easily and safely transported and protected until used;

It is a further object of this invention to provide such packaging for the pre-cut artificial fingernail fabric segments as outlined so that the packaging material itself can be used in the application of the fabric segments to the natural fingernail;

It is a further object of this invention to provide a complete method for creating an artificial fingernail adhering to an artificial fingernail tip which in turn adheres to the end of a natural nail and wherein the total artificial nail includes pre-cut and packaged fabric material in the appropriate shape and size to properly accommodate the individual fingernail upon which the artificial nail is being formed.

The foregoing and other objects and advantages will become apparent to those skilled in the art upon reading the description of a preferred embodiment which follows, in conjunction with a review of the appended drawings.

DESCRIPTION OF A PREFERRED EMBODIMENT

Figure 1:
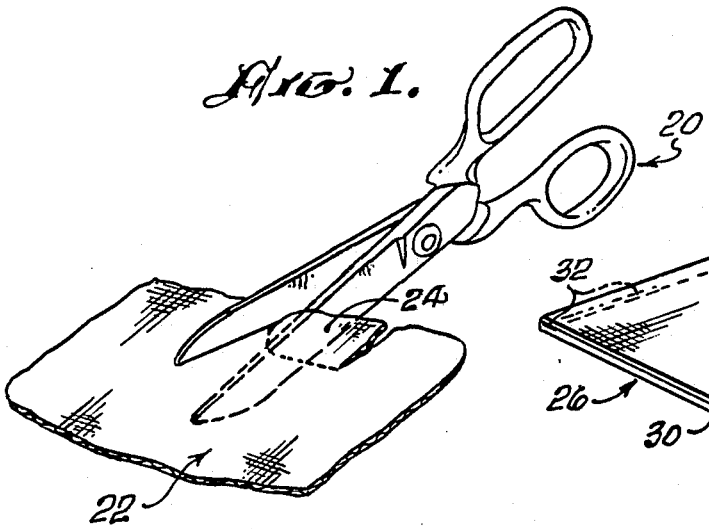
FIG. 1 illustrates the present generally used system of attempting to cut a fabric artificial fingernail piece from a sheet of fabric.

FIG. 1 shows a sheet 22 of fingernail fabric material being cut by scissors 20 into an individual fingernail segment 24. This is the customary manner of doing this at the present time and is most difficult due to the fragile nature of the fabric, usually resulting in uneven materials which cause considerable difficulty in final application.

Figure 2:
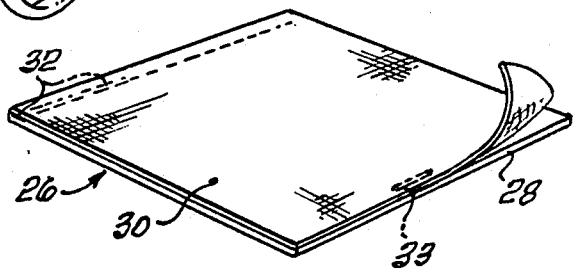
FIG. 2 illustrates a sheet of fabric being adhered to a base to be used in practicing the method of the present invention.

FIG. 2 illustrates a sheet of a poly-unwoven material 30 mounted upon a backing board 28 with adhesive 32 along one edge and a partial adhesive material holding the sheet in place at 33 along an opposing edge.

Figure 3:
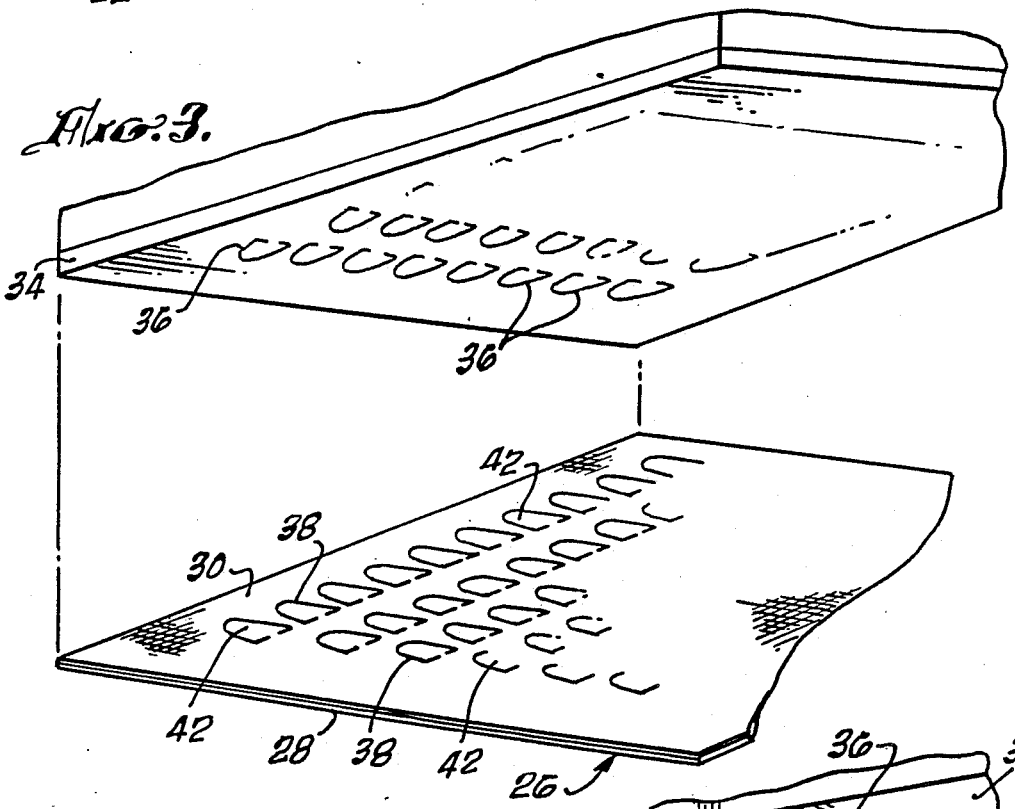
FIG. 3 illustrates a die and material on its base for cutting.
Figure 4:
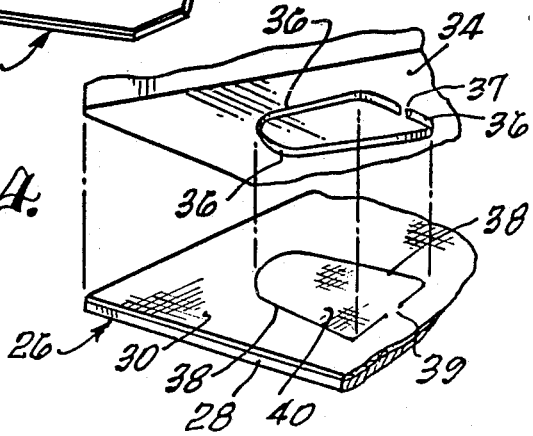
FIG. 4 illustrates an individual die and location of an individual cut sheet of fabric for a fingernail with the die lifted and reversed.

FIG. 3 and 4 illustrate the manner in which individual die-cutting segments 36 upon a die-cutting press of customary construction known to those skilled in the art will be caused to come in contact with the sheet of material 30 upon the backing 28 so as to cut individual segments 38 and 42 by reason of the individual die-cutting elements 36. The die-cutting elements 36 each have a small gap at 37 so as to leave an adhering stip of material at 39 after cutting along the edge 38 so as to form an individual piece 40 or 42 as illustrated in FIG. 3. The uncut portion 39 holds the individual cut item in place until ready for use.

Figure 5:
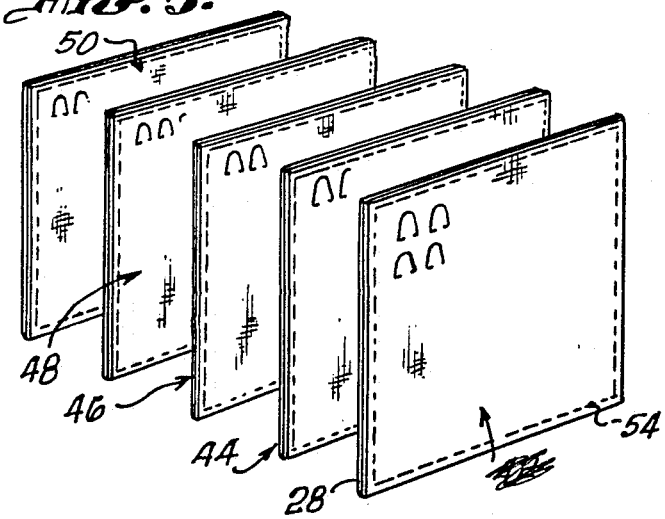
FIG. 5 illustrates a series of pre-cut sheets, one for each finger.

FIG. 5 illustrates the use of different sizes of cut items in a package of five assemblies, each on a backing strip 28 consisting of five sheets 42, 44, 46, 48 and 50, in this case utilizing a poly-silk material being bound all the way around the edges at 54 to the backing board 28 and utilizing otherwise the methods previously indicated.

Figure 6:
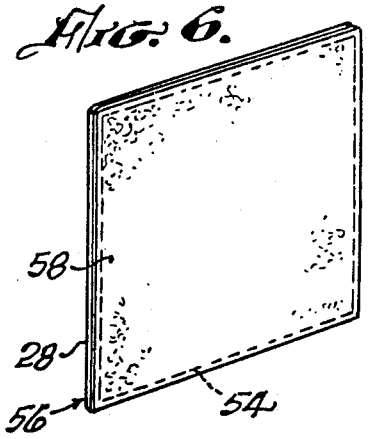
FIG. 6 illustrates an alternate embodiment of a sheet of material on a backing board for a different type material.

FIG. 6 is another view of a board similar to the board in FIG. 5 but in which case fiberglass material is being used as at 58 to a backing board 28 and bound around the edges at 54 as indicated.

Figure 7:
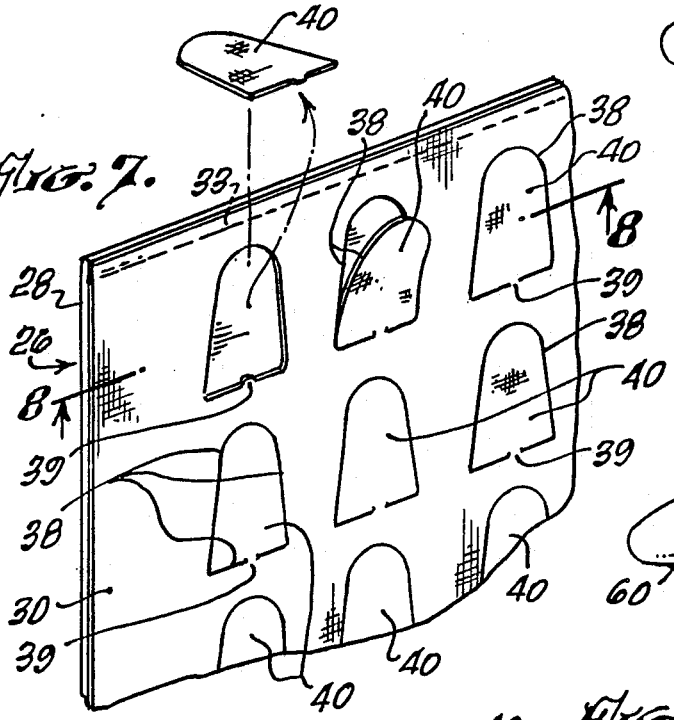
FIG. 7 shows the manner in which individual pre-cut fingernail pieces exist, and are removed, from the sheet of material on the backing board.

FIG. 7 is an enlarged portion showing individual fingernail segments 40 being bound at 39 and otherwise cut cleanly along the edges 38. It will be noted how one of the individual segments 40 has been removed and the uncut portion at 39 has been snapped away. Another segment 49 is ready to be taken from the overall sheet 30 from the complete assembly 26.

Figure 8:
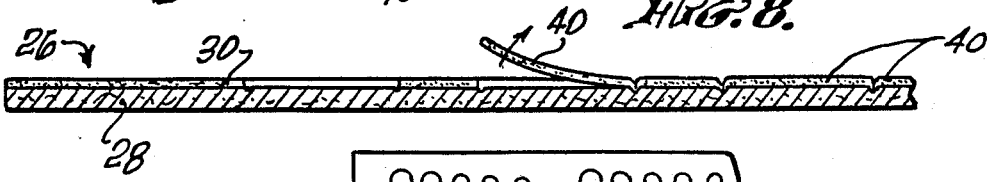
FIG. 8 is an enlarged section on 8—8 of FIG. 7.

FIG. 8 shows the sheet of material from FIG. 7 in section to illustrate the manner of lifting the individual element 40.

Figure 9:
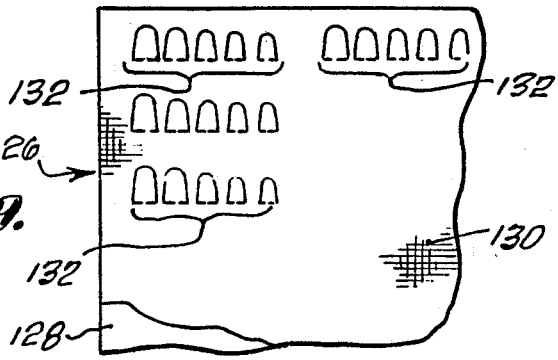
FIG. 9 is an alternate embodiment in which individual sets of segments for different fingers are cut.

FIG. 9 shows an alternate embodiment wherein the backing board 128 is covered by a fabric material 130 and wherein there are sets of cut portions at 132 so that there will be one individual size for each finger of a hand.

Figure 10:
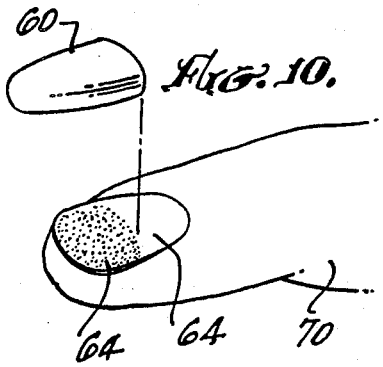
FIG. 10 shows the placing of an artificial tip on a natural fingernail.

FIG. 10 illustrates a finger 70 with natural fingernail 64 wherein the natural fingernail has been prepared at the end of the fingernail 64 for adhesion of an artificial fingernail 60. This adhesion will be by means of an adhesive of the like on the darkened portion of fingernail 64.

Figure 11:
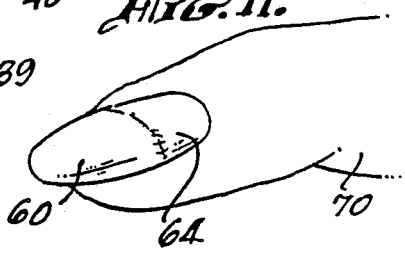
FIG. 11 illustrates the manner in which the artificial tip of FIG. 10 is cemented in place.

FIG. 11 shows the fingernail 64 with the tip 60 now adhered and having been buffed down along juncture and the juncture lines so as to make a smooth transaction from the natural fingernail to the extending tip.

Figure 12:
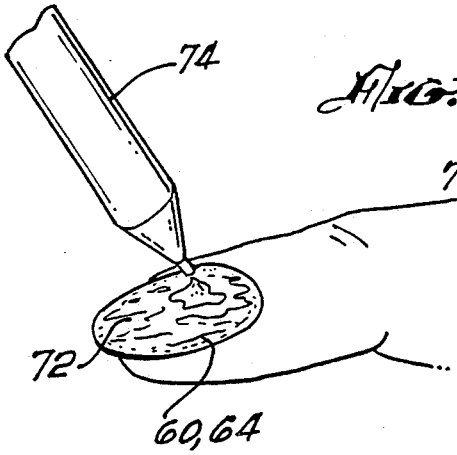
FIG. 12 illustrates the placing of polish adhesive on the nail and tip of FIG. 11.

FIG. 12 shows a dispenser 74 dispensing adhesive polish material 72, of customarily known adhesive polish materials upon the fingernail 60, 64, including its tip.

Figure 13:
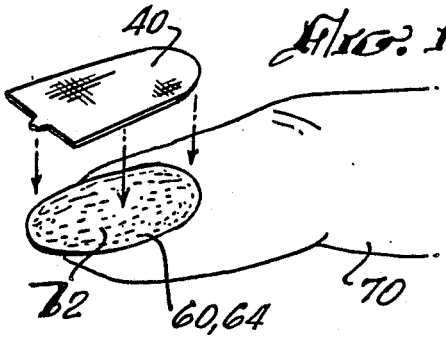
FIG. 13 illustrates the placement of the pre-cut fabric segment on the nail of FIG. 12.

FIG. 13 shows the placement of the individual segment of fabric 40 upon the polish adhesive material 72.

Figure 14:
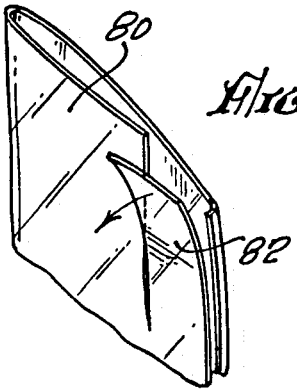
FIG. 14 illustrates the removal of a strip of plastic from the package.
Figure 15:
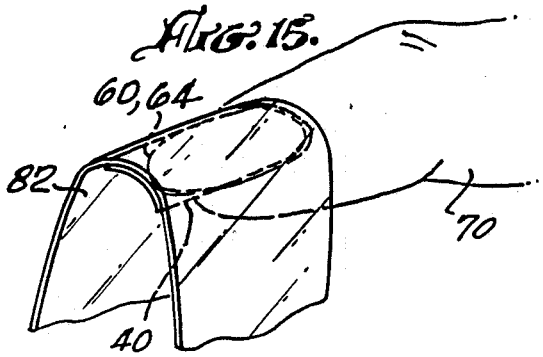
FIG. 15 shows the use of the strip of material of FIG. 14 over the fabric applied to the nail of FIG. 13.

FIG. 14 shows an envelope 80 formed of polyethylene or similar plastic material which will not adhere to the cement being used in FIGS. 12 and 13. This has been pre-marked and pre-scored so that strips such as 82 may be peeled from it for use as indicated in FIG. 15 which follows. This envelope 80 has been shown only in fragmentary portion, but it is understood to be of sufficient size to contain one or more of the board with the fabric material mounted as illustrated in the proceding figures. This will become the shipping container to protect the fabric material upon its boards and then to be used by strips which have been pre-marked and pre-scored as shown in FIG. 14 in the manner illustrated in FIG. 15.

FIG. 15 shows how the plastic material is draped over the fingernail fabric material 40. Pressure is applied in order to force the polish cement material upwardly through the fabric.

Figure 16:
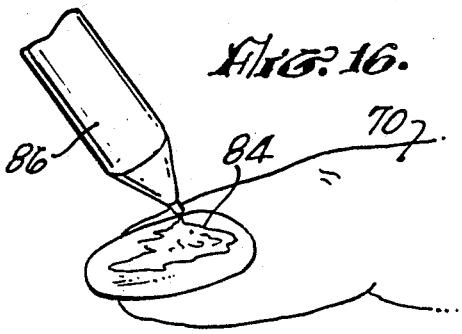
FIG. 16 illustrates material being placed upon the nail of FIG. 15 after removal of the plastic stip for purposes of hardening the polish cement.

FIG. 16 shows the application of the drying material, commonly known to those skilled in the art, upon the polish cement material by dispenser 86, at 84. This causes the polish material to set up hard. The fabric material has been trimmed now to correspond to the desired final shape. Also, it is to be understood that FIG. 16 would likewise be illustrative of a hardening material which is additionally a final polish material or a final polish material may be applied separately after the hardening process takes place. Thereafter the shaping of the final nail and appropriate polishing and buffing will take place in the manner known to those skilled in the art.

Figure 17:
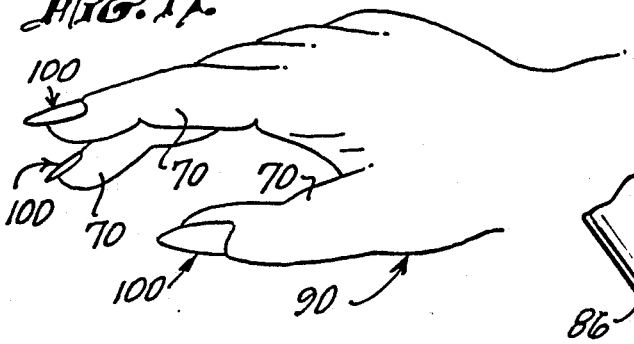
FIG. 17 shows the artificial nail as finished.

FIG. 17 illustrates a final product 100 which has been formed by all of the preceding steps upon the fingers 70. In this case, polishing and buffing has been accomplished.

While the embodiments of this invention shown and described are fully capable of achieving the objects and advantages desired, it is to be understood that these embodiments are for purposes of illustration only and not for purposes of limitation.

I claim:

1. The method of supplying artificial fingernail fabric material for use in creating artificial fingernails comprising: cutting a sheet of fabric material suitable to be used in creating artificial fingernails to a desired shape from which a multiplicity of individual artificial fingernail segments may be cut; mounting the cut piece of artificial fingernail fabric material upon a backing board along one edge thereof; die-cutting said fabric material upon said board in such manner as to cut the material into pre-determined fingernail shapes, leaving a very small portion of the die-cut shaped segment attached to the fabric material; premarking and scoring a plastic envelope of suitable size to contain the die-cut fabric material upon its backing board in such manner that individual strips may be removed from said plastic envelope; enclosing the die-cut fabric material upon its backing board within said plastic envelope; removing the die-cut fabric on its backing board from the plastic envelope when desired to use the material; taking an individual die-cut fingernail segment from the fabric material and tearing it from its joinder to the basic fabric sheet; and applying the individual segment to a natural fingernail.

2. The method of claim 1 wherein after the sheet of material on its backing board is removed from the envelope an individual pre-marked and scored strip is removed from the envelope for use in applying the fabric segment to the natural fingernail.

3. A plastic envelope which is pre-marked and scored so that various strips may be removed therefrom containing a sheet of fabric material suitable for use in creating artificial fingernails, said sheet of fabric material having pre-cut segments of the shape desired for the artificial fingernail, said sheet adhering on one edge thereof to a board upon which said sheet lays flat within said envelope.

* * * * *